US007892016B1

(12) United States Patent
Spalholz

(10) Patent No.: US 7,892,016 B1
(45) Date of Patent: Feb. 22, 2011

(54) ELECTRICAL WIRE CONNECTOR

(76) Inventor: Hans Spalholz, 113 Ward Loomis Rd., Bainbridge, NY (US) 13733

( * ) Notice: Subject to any disclaimer, the term of this patent is extended or adjusted under 35 U.S.C. 154(b) by 252 days.

(21) Appl. No.: 12/154,340

(22) Filed: May 22, 2008

(51) Int. Cl.
*H01R 4/24* (2006.01)

(52) U.S. Cl. ..... 439/393; 439/507

(58) Field of Classification Search ..... 439/387, 439/391, 393, 507
See application file for complete search history.

(56) References Cited

U.S. PATENT DOCUMENTS

| | | | | |
|---|---|---|---|---|
| 3,372,227 | A | 3/1968 | Allison | |
| 3,678,174 | A | 7/1972 | Ganzhorn | |
| 4,032,210 | A * | 6/1977 | Vogt | 439/393 |
| 4,053,703 | A | 10/1977 | Smith | |
| 4,195,194 | A * | 3/1980 | Kuster et al. | 174/59 |
| 4,654,473 | A | 3/1987 | Roux et al. | |
| 5,842,893 | A * | 12/1998 | De Keyser | 439/783 |
| 5,847,320 | A | 12/1998 | Fisher | |
| 5,961,341 | A * | 10/1999 | Knowles et al. | 439/403 |
| 6,548,761 | B1 | 4/2003 | Wang | |
| 6,722,902 | B2 | 4/2004 | Kedzierski | |
| 6,730,847 | B1 | 5/2004 | Fitzgerald et al. | |

* cited by examiner

*Primary Examiner*—Khiem Nguyen
(74) *Attorney, Agent, or Firm*—Mark Levy; Hinman, Howard & Kattell, LLP

(57) ABSTRACT

An electrical wire connector. In a housing is disposed metal bushings in which wires are inserted. The bushings are embedded in the insulation cap for permanent placement. The bushings are connected via a bridge to carry current from bushing to bushing. The insulation cap top openings are shaped with bell mouths for easy insertion of electrical wires. Each metal bushing has cutting lances to strip the wires as they are inserted into the connector. Pressure lances secure each wire in position. A spring loaded tab is provided for additional contact.

3 Claims, 3 Drawing Sheets

ELECTRICAL WIRE CONNECTOR

FIELD OF THE INVENTION

This invention relates to devices for connecting electrical wires and, more particularly, to a device to accommodate a plurality of wires with a mechanism for retaining and stripping the wires.

BACKGROUND OF THE INVENTION

Electrical wires are conventionally joined by stripping the ends of insulation, scraping them clean, twisting the ends together, and applying solder to electrically join the ends together. If inadequate heat or flux are applied, or the wires not properly cleaned, a high resistance or cold soldered joint results. To overcome these problems, wire nut solder-less connectors were introduced which comprise a plastic outer shell and an inner electrically conductive, tapered cylinder with a screw thread. To apply this connector, previously-stripped, bare ends of the wires are oriented in the same direction, twisted together and inserted into the wide end of the wire nut. Twisting the wire nut crimps the wires together as the tapered thread advances on the wires and cuts into them, electrically joining them.

Problems arise with use of wire nuts when heavy conductors or more than two conductors are to be joined. The joint becomes bulky. It is difficult to arrange for all of the conductors to be exposed to the screw thread. If all of the conductors are not joined, the joint may lower the voltage in the line and heat up to the point of causing a fire. Wire nuts remain quick and convenient splicing devices, but they would be greatly enhanced by including means to overcome the difficulties associated with their use on heavy and multiple conductors.

DISCUSSION OF RELATED ART

U.S. Pat. No. 6,730,847, issued May 4, 2004 to Fitzgerald et al., shows a connection protector kit for use with an electrical stub connection including a flexible cap having first and second opposed ends and an interior wall defining a cavity. The first end is closed and an opening is formed in the second end and communicates with the cavity. A gel is disposed in the cavity. The cavity and the gel are adapted to receive the stub connection. Retaining means may be provided to retain the cap on the connection.

U.S. Pat. No. 6,722,902, issued Apr. 20, 2004 to Kedzierski, shows an apparatus for connecting electrical wires comprising a connector block having three wells, wherein each well receives an electrically conducting wire, and three pins, each having two ends wherein the first end of each pin is removably contained its own well and the second end of each pin is in electrical contact with a pin of an XLR connector. The connector further comprises a plate for removably securing these pins and a body encasing the connector block and the first end of each pin, wherein the connector strip is a terminal strip and allows for the receipt of a second set of electrically conducting wires in contact with each pin and provides an electrical connection to a second audio component so as to effectuate a daisy chain between a multitude of audio components.

U.S. Pat. No. 6,548,761, issued Apr. 15, 2003 to Wang, shows a one-way cable terminal connector including a connector base having a crossed open chamber and an upright post in the open chamber, two V-shaped metal spring plates respectively coupled to the upright post in the open chamber, each spring plate having a retaining end piece adapted to hold down the core of a respective cable being inserted into the connector base, and a metal column fixedly fastened to the upright post to secure the spring plates in place for contacting and supporting the core of inserted cables.

U.S. Pat. No. 5,847,320, issued Dec. 8, 1998 to Fisher, shows a solderless connecting and splicing device and method employs a wire nut with a conductive element inside a rigid insulator. The conductive element has a frusto-conical passage with a tapered internal thread. Instead of twisting conductors together and inserting them directly into the wire nut, this invention provides a tube assembly of a number of conductive tubular elements joined together in parallel. A conductor is inserted into each element and the assembly inserted into the wire nut. The nut is then twisted. As the assembly is drawn into the smaller end of the passage the tubular elements collapse and crimp against the conductors to form a low resistance splice.

U.S. Pat. No. 4,654,473, issued Mar. 31, 1987 to Roux et al., shows heat-shrinkable devices for forming solder connections between electrical conductors. The devices each comprise of a hollow, heat-shrinkable sleeve having first and second ends, and contain a quantity of solder. Both ends contain heat-softenable sealing material which seal the ends upon recovery of the article, the sealing material at the second end being less responsive to heat than the sealing material at the first end. The conductors to be connected are inserted into the first end of the sleeve and the sleeve recovered.

U.S. Pat. No. 4,053,703, issued Oct. 11, 1977 to Smith, shows a formed member with a plurality of deformable jaws capable of being associated with the ends of small service wires to clamp the insulation and conductive shield. The clamping connector thus forms an electrical coupling with the shield and at the same time locates the ends of the service wires relative to one another. An attachment portion enables the shield to be grounded and the clamped service wires to be positioned relative to a splice enclosure or other fixture. The deformable jaws interlock when deformed to hold a service wire.

U.S. Pat. No. 3,678,174, issued Jul. 18, 1972 to Ganzhorn, shows an insulation sleeve of the type used to provide electrical insulation around an electrical connection. This sleeve has at least one end which has a re-entrant configuration projecting back into the interior of the sleeve such that at least a portion of the re-entrant is held away from the inside surface of the sleeve. This provides a self-locking feature when an object of an appropriate size is inserted through this end. The sleeve may then be heat shrunk around the connection or can serve as an insulator without further recovery. The sleeve may also be provided with a solder insert.

U.S. Pat. No. 3,372,227 issued Mar. 5, 1968 to Allison, shows an electrical connector unit having an inner sleeve of deformable sheet metal having opening with edge portions which define teeth adapted to pierce the insulation of wire lead end portions confined within the sleeve. The sleeve has an entrance at one end through which the wire lead end portions have access to the interior area of the sleeve so as to occupy a position opposite the teeth.

SUMMARY OF THE INVENTION

In accordance with the present invention there is provided an electrical wire connector. In a housing are disposed metal bushings in which wires are inserted. The bushings are permanently embedded in the insulation cap. The bushings are connected via a bridge to carry current from bushing to bushing. An insulation cap is shaped for convenient manipulation when the wires are inserted. The insulation cap top openings are shaped with bell mouths for easy insertion of electrical wires. Each metal bushing has cutting lances to strip the wires as they are inserted into the connector. Pressure lances secure each wire in position. A spring loaded tab is provided for additional contact.

It is an object of the invention to provide a connector that eliminates the need to twist the electrical wires.

It is a further object of the invention to provide a connector that eliminates the need for stripping the wires.

These and other objects, advantages and features of the invention will become apparent when the detailed description is studied in conjunction with the drawings.

For purposes of brevity and clarity, like components and elements of the apparatus of this invention bear the same designations or numbering throughout the figures.

DETAILED DESCRIPTION OF THE PREFERRED EMBODIMENT

Briefly, the present invention is an electrical wire connector. In a housing are disposed metal bushings in which wires are inserted. The bushings are permanently embedded in the insulation cap. The bushings are connected via a bridge to carry current from bushing to bushing. An insulation cap is shaped for convenient manipulation when the wires are inserted. The insulation cap top openings are shaped with bell mouths for easy insertion of electrical wires. Each metal bushing has cutting lances to strip the wires as they are inserted into the connector. Pressure lances secure each wire in position. A spring loaded tab is provided for additional contact.

Figure 1:
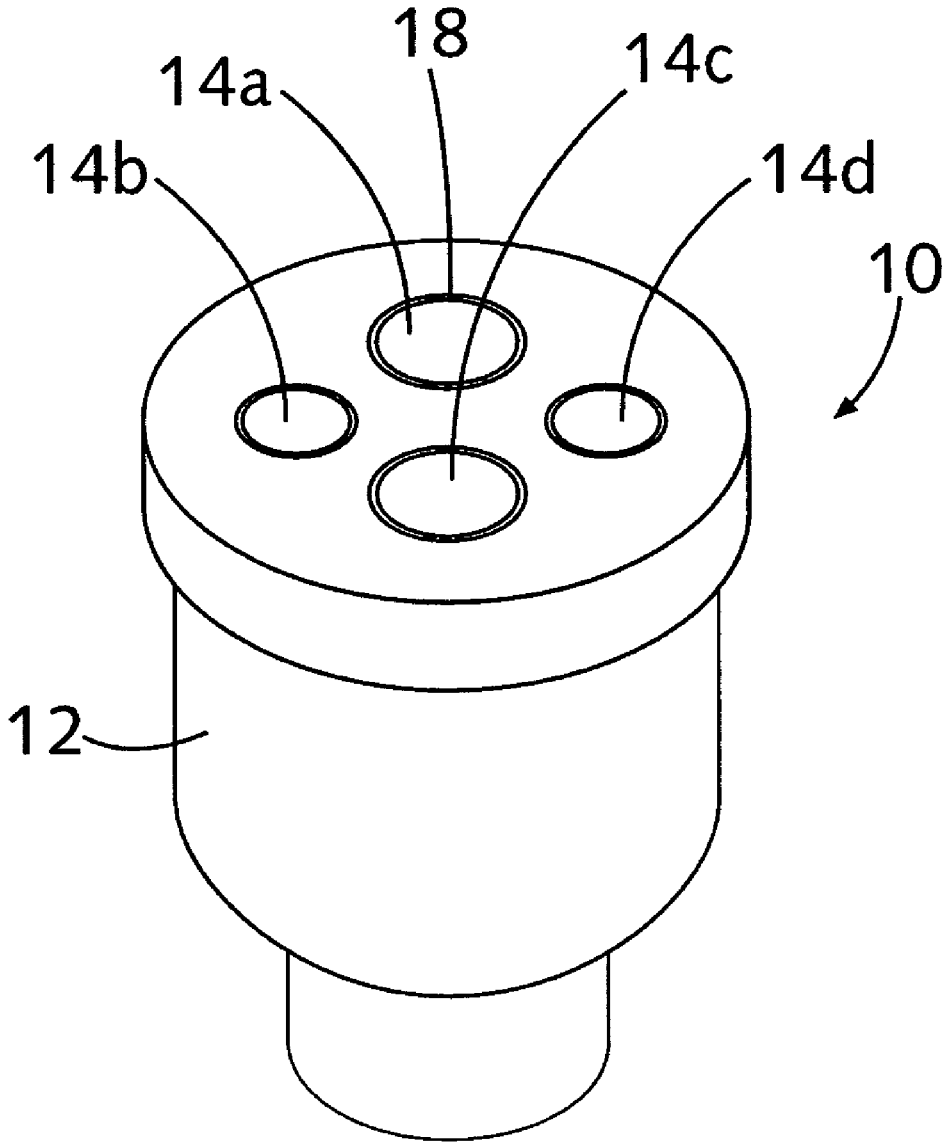
FIG. 1 is a perspective view of the electrical wire connector in accordance with the present invention.

Referring to FIG. 1, a wire connector 10 of the present invention is shown. In the preferred embodiment, an insulation cap 12 constructed of non-conductive plastic, rubber, ceramic or polycarbonate has four bell-shaped insertion apertures or holes 14*a*, 14*b*, 14*c*, 14*d* for the insertion of up to four electrical wires, not shown. Of course, it should be understood that any number of holes can be provided, depending upon the purpose of the wire connector 10. Holes 14*a*-14*d* can have different diameters, as shown, to accommodate different wire gauges, such as but not limited to 12AWG, 14AWG, etc. American Wire Gauge (AWG) diameters can be calculated by applying the formula $D(AWG)=0.005\cdot 92^{((36-AWG)/39)}$ inch. Note, in the preferred embodiment, two of the holes 14*a*, 14*c* are larger than the remaining two holes 14*b*, 14*d*. In fact, depending on requirements, any combination of holes 14*a*-14*d*, and, as aforementioned, any number thereof, can be used (see FIGS. 3*a*-3*g*). Extending from apertures 14*a*-14*d* are corresponding channels for receiving wire, not shown.

Insulation cap 12 is shaped for convenient manipulation when electrical wires are inserted. Holes 14*a*-14*d* have metal, electrically conductive bushings 18.

Figure 2:
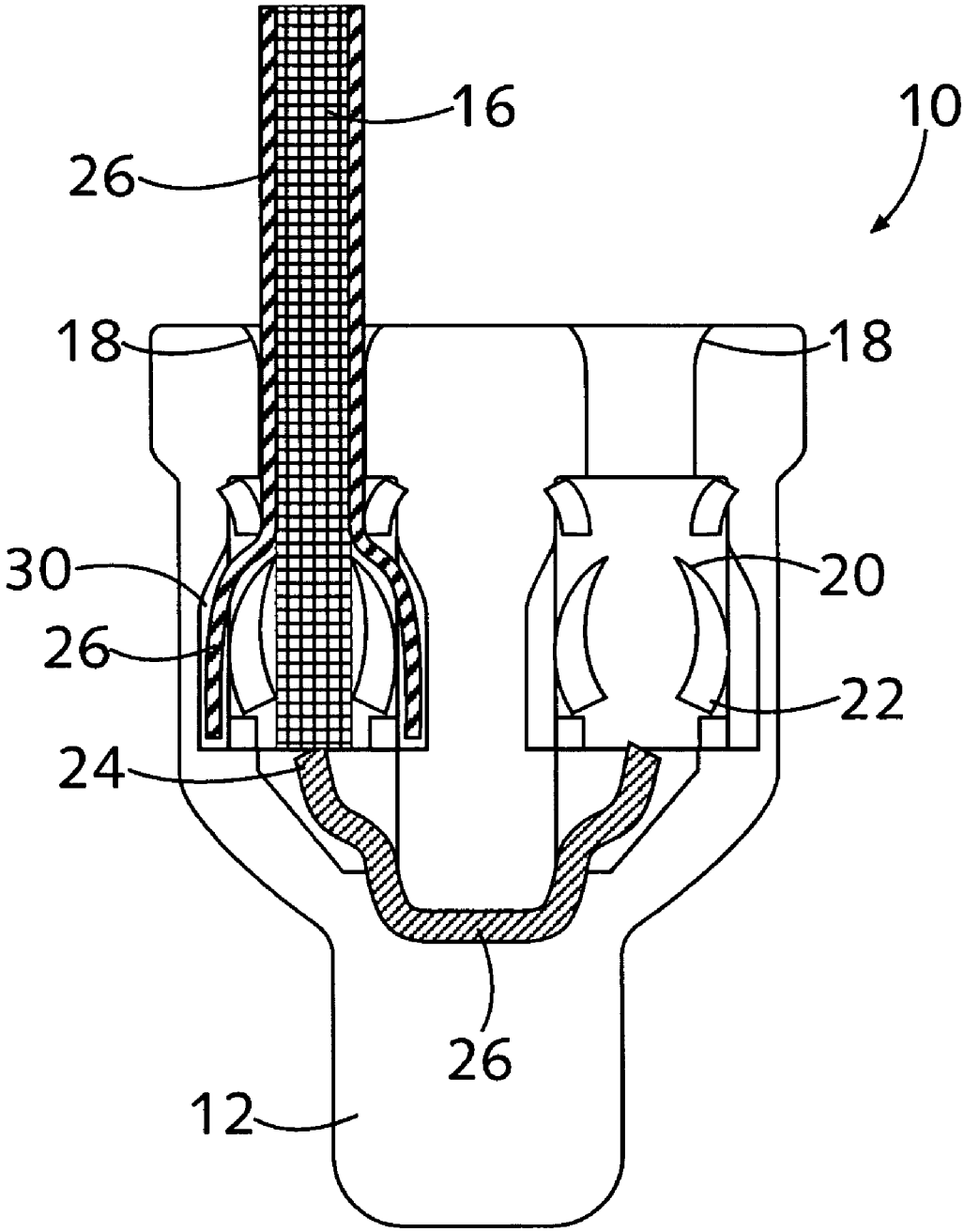
FIG. 2 is a cross-sectional view of the connector with wires inserted in accordance with the present invention.
Figure 3A:
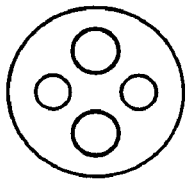
FIGS. 3*a*-3*g* are patterns of openings for the connector.
Figure 3B:
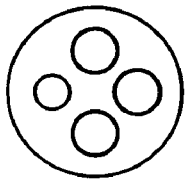
Figure 3C:
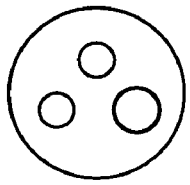
Figure 3D:
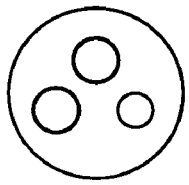
Figure 3E:
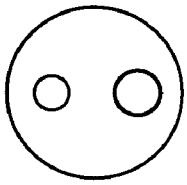
Figure 3F:
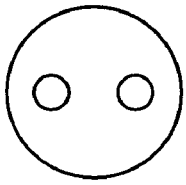
Figure 3G:
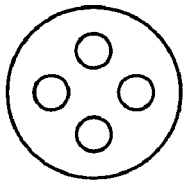

Referring now to FIG. 2, each metal bushing 18 has at least one sharpened protuberance or cutting lance 20 parallel to the wire 16, at least one biasing member or pressure lance 22 parallel to the wire 16, and a spring loaded tab 24 disposed at the end of wire 16. Bushings 18, are also disposed in insulation cap 12 and are connected via a metal bridge 26 to conduct electricity from bushing to bushing 18.

When wire 16 is inserted into hole 14*a*, electrical wire insulation 26 is cut by cutting lance 20. Wire insulation 26 is forced into a pocket 30 provided therefor. It should be understood that stripped wires can also be used with this device 10. Pressure lance 22 moves the stripped wire 16 against the bushing 18 to ensure electrical contact therebetween and secures wire 16 in place. Wire 16 makes contact with spring loaded tab 24 to ensure additional contact at the tip of the wire 16.

Referring now to FIGS. 3*a*-3*g*, it can be seen that a number of hole configurations can be provided, depending upon the requirements of the user.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this inventive method.

Having described the invention, what is desired to be protected by Letters Patent is presented in the subsequent appended claims.

What is claimed is:

1. An electrical wire connector, comprising:

(a) an electrically non-conductive housing having a plurality of apertures formed therein and a wire insertion channel corresponding thereto and extending therefrom;

(b) an electrically conductive bushing disposed in each of said plurality of apertures;

(c) an electrically conductive bridge operatively connected to at least two of said bushings for conducting electricity therebetween;

(d) a cutting lance proximate each of said wire insertion channels for cutting insulation as an insulated electrical wire is inserted therein;

(e) a pressure lance proximate each of said wire insertion channels for biasing an electrical wire against its respective bushing to ensure electrical contact therebetween and (f) a spring-loaded tab operatively connected to said electrically conductive bridge for biasing said wire thereagainst.

2. The electrical wire connector in accordance with claim 1, wherein at least one of said apertures has a diameter substantially identical to the diameter of another of said apertures.

3. The electrical wire connector in accordance with claim 1, further comprising:

(g) a window proximate said cutting lance for receiving stripped insulation.

* * * * *